US012742364B2

(12) United States Patent
Engel et al.

(10) Patent No.: US 12,742,364 B2
(45) Date of Patent: Sep. 22, 2026

(54) METHOD OF SEALING A WELL WITH MULTIPLE ANNULI

(71) Applicant: SCHLUMBERGER TECHNOLOGY CORPORATION, Sugar Land, TX (US)

(72) Inventors: David Engel, Larose, LA (US); Dustin Cavin, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 19/131,953

(22) PCT Filed: Nov. 22, 2023

(86) PCT No.: PCT/US2023/080961
§ 371 (c)(1),
(2) Date: May 22, 2025

(87) PCT Pub. No.: WO2024/112920
PCT Pub. Date: May 30, 2024

(65) Prior Publication Data

US 2026/0193956 A1 Jul. 9, 2026

Related U.S. Application Data

(60) Provisional application No. 63/384,824, filed on Nov. 23, 2022.

(51) Int. Cl.
*E21B 33/14* (2006.01)
*E21B 33/12* (2006.01)

(52) U.S. Cl.
CPC ..... *E21B 33/14* (2013.01); *E21B 33/12* (2013.01)

(58) Field of Classification Search
CPC ..... E21B 33/12; E21B 33/14
See application file for complete search history.

(56) References Cited

U.S. PATENT DOCUMENTS

| | | | | |
|---|---|---|---|---|
| 5,372,198 | A | 12/1994 | North | |
| 9,376,884 | B2 * | 6/2016 | Clarke | E21B 33/1216 |
| 10,612,343 | B2 * | 4/2020 | Hess | E21B 43/045 |
| 2004/0244994 | A1 | 12/2004 | Jackson | |
| 2015/0166873 | A1 * | 6/2015 | Tomlinson | C09K 8/46 106/689 |
| 2015/0369019 | A1 | 12/2015 | Raffn | |
| 2019/0128095 | A1 | 5/2019 | Hess | |
| 2020/0325746 | A1 * | 10/2020 | Lerbrekk | E21B 33/13 |
| 2021/0010341 | A1 | 1/2021 | Rairigh | |

FOREIGN PATENT DOCUMENTS

| | | | |
|---|---|---|---|
| GB | 2501381 | A | 10/2013 |
| WO | 2022150175 | A2 | 7/2022 |

* cited by examiner

*Primary Examiner* — D. Andrews
(74) *Attorney, Agent, or Firm* — Jeffrey D. Frantz

(57) ABSTRACT

Described herein are systems and methods for sealing a well with multiple annuli. In an example, a downhole assembly can be lowered into a cavity of a production tube. Openings can be created in the production tube and an inner casing. The downhole assembly can create a seal between the production tube and the inner casing that allows barrier fluid to freely flow into an outer annular gap between the inner casing and an outer casing. A barrier fluid can be injected such that the barrier fluid flows through the radial openings into the outer annular gap.

20 Claims, 2 Drawing Sheets

METHOD OF SEALING A WELL WITH MULTIPLE ANNULI

CROSS-REFERENCE TO RELATED APPLICATION

This application is a National Stage and claims benefit of PCT Patent Application No. PCT/US2023/080961, entitled "Method of Cementing Multiple Annuli," filed Nov. 22, 2023, which claims priority to and the benefit of U.S. Provisional Patent Application Ser. No. 63/384,824, entitled "Method of Cementing Multiple Annuli," filed Nov. 23, 2022, which is hereby incorporated by reference in its entirety for all purposes.

FIELD

The present disclosure generally relates to decommissioning of a well and more particularly to cementing multiple annuli in a well.

BACKGROUND

The current standard practice for decommissioning a well includes pulling a tubular element to create a singular annular space. This necessitates remediation through casing perforation to ensure a secure barrier against uncontrolled oil flow. While this method is prevalent, its limitations become apparent in the context of workflow efficiency. The current state of the art only allows for the cementing of one annulus at a time, resulting in a less-than-optimal process. While this method is prevalent, its limitations become apparent in the context of workflow efficiency.

Recognizing the drawbacks of this singular approach, there is a clear need for innovation to overcome these limitations. The proposed invention addresses the inefficiencies associated with the one-annulus-at-a-time cementing process.

SUMMARY

Examples described herein include systems and methods for cementing multiple annuli without the necessity for removing tubular elements. One aspect of the invention is the ability to provide wellbore access from within the production tubing to external spaces. Traditionally, achieving this connection required the formation of a hydraulic connection across tubing elements. The conventional method often involved the use of energetic charges, strategically deployed to pierce through various tubulars radially. This piercing action creates a hydraulic communication pathway, a process that the current invention optimizes and streamlines.

By eliminating the need for tubular element removal and offering a more efficient means of establishing hydraulic connections, the disclosed innovation significantly enhances the decommissioning workflow. The potential applications of this inventive approach extend to a wide range of scenarios within the oil and gas industry, promising improved operational efficiency and cost-effectiveness.

The systems and methods described herein can occur in a well environment that includes multiple annular gaps. For example, a wellbore can have a production tube, an inner casing, and an outer casing. One annular gap can be present between the production tube and the inner casing, and another annular gap can be present between the inner casing and the outer casing. In an example, a downhole assembly can be lowered into the internal cavity of the production tube to a predetermined depth. The downhole assembly can create a seal between the outer surface of the production tube and the inner surface of the inner casing of the well. This can be done using any appropriate means. In one example, the downhole assembly can include a hydraulic ram that mechanically expands the production tube. In another example, the downhole assembly can include a colliding tool that creates a small explosion for expanding the production tube without rupturing it. In another example, a perforating gun on the downhole assembly can be ignited to blow openings in the production tube, and the downhole assembly can inject a rapidly drying, high-viscous material that sets before descending in a downhole direction.

After the seal is created, the downhole assembly can create radial openings in the production tube and the inner casing. The radial openings can have a greater downhole depth differential than the seal so as to prevent uphole flow of barrier fluid, thereby forcing barrier fluid into the annular gap between the inner and outer casings.

The downhole assembly can include a barrier fluid injector for injecting a barrier fluid into the well to seal the well, such as concrete. The downhole assembly can first create a seal between a barrier fluid injector and the inner surface of the production tube to prevent uphole flow of the barrier fluid within the production tube inner cavity. The barrier fluid injector can then inject a barrier fluid into the well. In one example, the barrier fluid can be injected into the internal cavity of the production tube. In another example, the barrier fluid can be injected radially through the radial openings in the production tube. The seal between the production tube and the inner casing can cause the barrier fluid to flow through the radial openings in the inner casing and into the annular gap between the inner and outer casings.

Both the foregoing general description and the following detailed description are exemplary and explanatory only and are not restrictive of the examples, as claimed.

DESCRIPTION OF THE EXAMPLES

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Although many examples described herein refer to cement as a medium for sealing a well or creating a seal between annuli, this is merely exemplary and not meant to be limiting in any way. For example, any hardening fluid can be injected into a wellbore or annuli between casings to create a seal.

Figure 1:
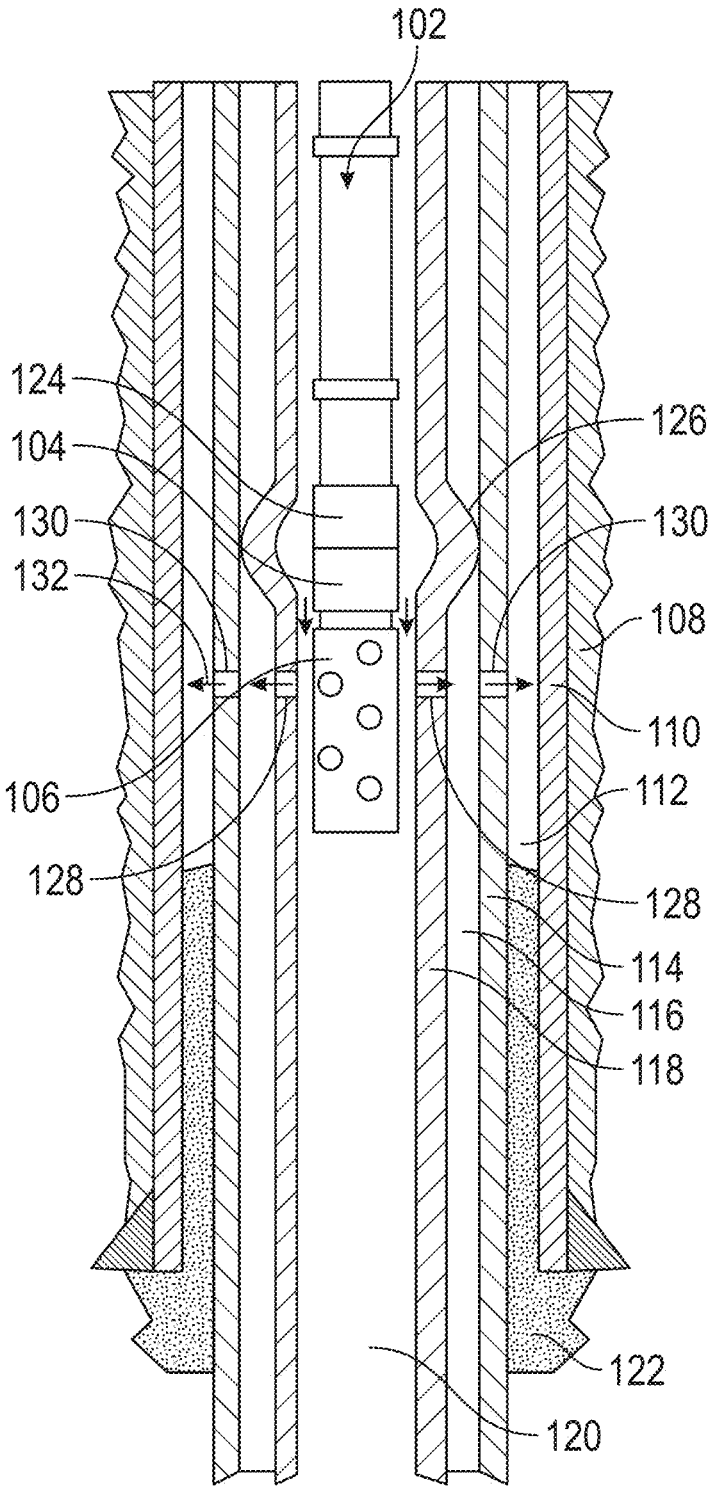
FIG. 1 is a diagram of an example downhole assembly for sealing a well with multiple annuli.

FIG. 1 is a diagram of an example downhole assembly 102 for sealing a well with multiple annuli. The well includes a production tube 118, an inner casing 114, and an outer casing 110. Natural rock formation 108 can surround the outer casing 110. The inner casing 114 can be nested inside the outer casing 110 with an outer annular gap 112 that separates the outer surface of the inner casing 114 from the inner surface of the outer casing 110. The production tube 118 can be nested inside the inner casing 114 with an inner annular gap 116 that separates the outer surface of the production tube 118 from the inner surface of the inner casing 114. The downhole assembly 102 can be lowered into the internal cavity 120 of the production tube 118 to perform the operations described herein.

The downhole assembly 102 can include a barrier fluid injector 104 that injects barrier fluid 132 (e.g., cement) into the well. The barrier fluid injector 104 can be configured to inject barrier fluid 132 radially or longitudinally. The downhole assembly can also include a sealing mechanism 124 that can create a seal 126 between the production tube 118 and the inner casing 114. The sealing mechanism 124 can be any mechanism that can expand the production tube 118 until the outer surface of the production tube 118 contacts the inner surface of the inner casing 114 to form the seal 126. As an example, the downhole assembly 102 can include a hydraulic ram that exerts a radial force on the production tube 118 to form the seal 126. In another example, the sealing mechanism 124 can be a colliding tool that ignites one or more charges with enough force to expand the production tube 118 without rupturing it.

Before performing the cementing operation described herewith, perforation can be performed to enable access through the tubular elements (e.g., a production tube 118 and an inner casing 114). Perforation can be performed by a perforation gun 106 that is part of the downhole assembly 102.

Cementing is a challenging operation due to the viscous behavior of cement as it is pumped from inside of the tubing. If pumped from a static location, the cement will follow the path of least resistance, resulting in a differential in the height of the cement pumped between the inner annular gap 116 and the outer annular gap 112.

The operation described herewith aims to enable the isolation of fluid flow to enable the outer annular gap 112 to be pumped with cement prior to the inner annular gap 116. As a result, a sufficient height of cement would be able to be pumped from the lower end of the target annular space, followed by direct pumping of cement into the inner annular gap to allow for a continuous barrier to be established.

The disclosed process includes first staging the well for cementing with at least a fundament barrier 122 which prevents the longitudinal flow of cement in a downhole direction. The fundament barrier 122 can be established using any appropriate means, such as by injecting a rapidly drying, high-viscous material. The staging also includes establishing hydraulic access across the various casings to enable radial cross flow in the target zone. Any mechanism for establishing hydraulic access can be used, including for example, the perforating gun 106. The staging can also include performing the necessary steps to ensure that the annular gaps 112 and 116 are free of any obstructions that would prevent adequate cementation in the future steps (often referred to as washing).

Figure 2:
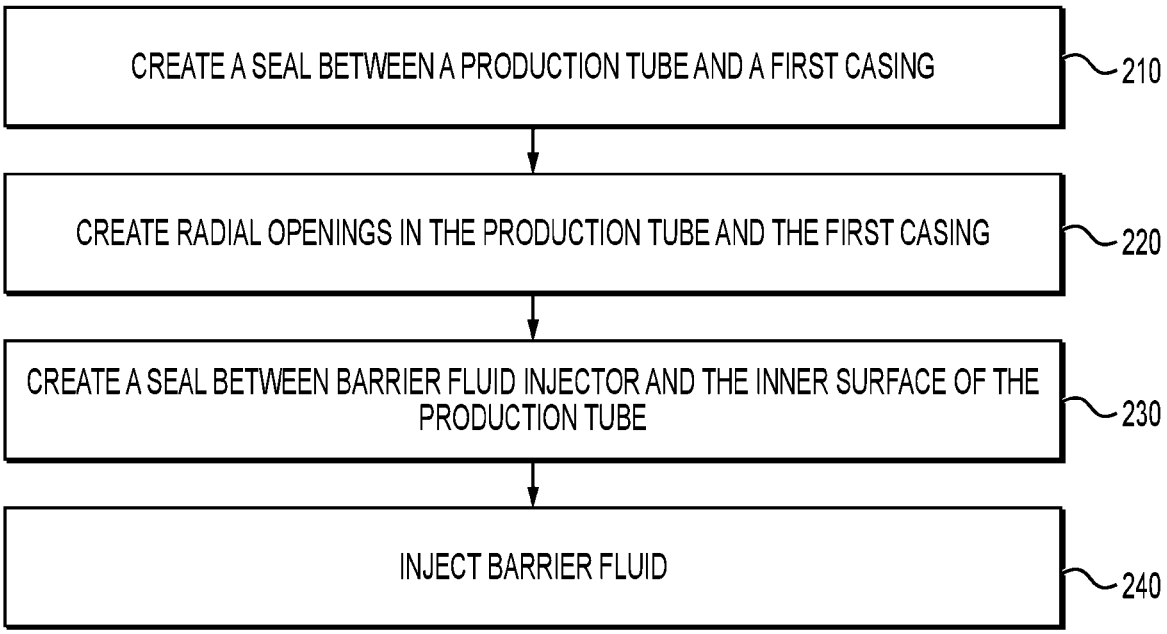
FIG. 2 is a flowchart of an example method for sealing a well with multiple annuli.

FIG. 2 is a flowchart of an example method for sealing a well with multiple annuli. At stage 210, the downhole assembly can create a barrier or seal 126 between the production tube 118 and the inner casing 114. In one example, this can be done by pumping a small cement (or other rapidly drying, high-viscous material) section and then re-perforating. In some examples, the seal 126 can be created by radially expanding the production tube 118 until the outer surface of the production tube 118 contacts the inner surface of the inner casing 114. This can be done using the sealing mechanism 124. For example, the sealing mechanism 124 can be a hydraulic ram that exerts a radial force on the production tube 118 that expands a portion of the production tube 118 until it contacts the inner casing 114 to form the seal 126. In another example, the sealing mechanism 124 can be a colliding tool that ignites an explosive with enough force to expand the production tube 118 without rupturing the production tube 118 or inner casing 114. In another example, a mechanical device, such as a colliding tool, can be used to create the seal 126 (e.g., a castellated seal) between the production tube 118 and the inner casing 114.

At stage 220, the downhole assembly 102 can create radial openings 128 and 130 in both the production tube 118 and the first casing 114. This refers to the process described above whereby hydraulic access is established across the various casings to enable radial cross flow in the target zone and into the outer annular gap 112. Any mechanism for creating the radial openings 128 and 130 in at least the production tube 118 and the inner casing 114 can be used, including for example, the perforating gun 106.

At stage 230, the downhole assembly 102 can create a seal 126 that prevents the barrier fluid 132 flow upward during the initial operation within the internal cavity 120. This will force the barrier fluid 132 to flow through the radial openings 128 and 130 created in stage 220. In one example, a packer can be used to create the seal 126. The seal 126 between the production tube 118 and the inner casing 114 can be placed uphole of the radial openings 128 and 130, so that the barrier fluid 132 is also forced to flow into the outer annular gap 112.

At stage 240, the downhole assembly 102 can inject the barrier fluid 132. In one example, the barrier fluid injector 104 can inject the barrier fluid 132 into the internal cavity 120, and as the internal cavity fills, the barrier fluid 132 can be forced through the radial openings 128 and 130 into the surrounding annular cavities 116 and 112. In another example, the barrier fluid injector 104 can inject the fluid radially so that the barrier fluid 132 flows directly into the inner annular gap 116 and then into the outer annular gap 112.

The method described above can be performed repeatedly at a series of predetermined depths. For example, the downhole assembly 102 can perform the method at a first depth so that the annular gaps 112 and 116 fill up to a set depth. The downhole assembly 102 can then be retracted a predetermined distance and the method can begin again to seal the next segment of the well. As an example, the amount of volume pumped at each segment can be based on the calculation of the volume required to be filled with cement in the outer annular gap 112 (plus a margin). The internal sealing element can then be released to allow flow radially and enable the downhole assembly 102 to move longitudinally. The downhole assembly 102 can continue to pump cement (barrier fluid) and move the downhole assembly 102 axially at a target rate timed to cement flow rate until the target height of cement is established. Equipment at the surface can then retract the downhole assembly a predetermined amount and the process can be repeated.

Alternatively, the internal sealing element can be released, then the downhole assembly 102 can be pulled to a target distance away from the cement to ensure that the downhole assembly 102 is not locked in position. The downhole assembly 102 can be returned into the target zone, and barrier fluid can be circulated to ensure that the zone is prepared for the next operation. A diagnostic measurement can be performed to confirm the proper set of the cement in outer annular gap 112. The downhole assembly 102 can be lowered into the target zone and cement can be pumped into the internal cavity 120 at a target flow rate and the downhole assembly 102 can be moved longitudinally upward at a set rate to fill both the internal cavity 120 until the target height of cement is established.

Other examples of the disclosure will be apparent to those skilled in the art from consideration of the specification and practice of the examples disclosed herein. Though some of the described methods have been presented as a series of steps, it should be appreciated that one or more steps can occur simultaneously, in an overlapping fashion, or in a different order. The order of steps presented are only illustrative of the possibilities and those steps can be executed or performed in any suitable fashion. Moreover, the various features of the examples described here are not mutually exclusive. Rather any feature of any example described here can be incorporated into any other suitable example. It is intended that the specification and examples be considered as exemplary only, with a true scope and spirit of the disclosure being indicated by the following claims.

What is claimed is:

1. A method for sealing a well, comprising:

creating a first seal between an outer surface of a production tube and an inner surface of a first casing of the well, the production tube being nested inside the first casing and the first casing being nested inside a second casing, wherein creating the first seal comprises radially expanding the production tube;

creating a first radial opening in the production tube, the first radial opening having a greater downhole depth differential than the first seal;

creating a second radial opening in the first casing;

creating a second seal between a barrier fluid injector and an inner surface of the production tube; and injecting a barrier fluid into an internal cavity of the production tube, wherein injecting the barrier fluid causes the barrier fluid to flow through the first radial opening into a first annular gap between the production tube and the first casing, the first seal prevents the barrier fluid from flowing in an upward direction within the first annular gap, and injecting the barrier fluid causes the barrier fluid to flow through the second radial opening into a second annular gap between the first casing and the second casing.

2. The method of claim 1, wherein creating the first seal between the outer surface of the production tube and the inner surface of the first casing of the well comprises:

initiating a firing sequence of a perforating gun to create a third radial opening in the production tube; and injecting a material through the third radial opening to solidify inside the first annular gap.

3. The method of claim 1, wherein radially expanding the production tube comprises radially expanding the production tube until the outer surface of the production tube contacts the inner surface of the first casing.

4. The method of claim 1, wherein radially expanding the production tube comprises radially expanding the production tube using a hydraulic ram.

5. The method of claim 1, comprising repeating the method at a plurality of depths in the well.

6. The method of claim 1, wherein radially expanding the production tube includes detonating an explosive in the internal cavity of the production tube.

7. The method of claim 6, wherein the explosive is detonated by a colliding tool.

8. The method of claim 6, wherein the detonation of the explosive creates enough force to expand the production tube until the outer surface of the production tube contacts the inner surface of the first casing without rupturing the production tube.

9. The method of claim 1, wherein the barrier fluid is injected radially through the first radial opening.

10. The method of claim 1, wherein the second seal is created by a packer.

11. The method of claim 1, wherein the barrier fluid is a cement composition.

12. The method of claim 1, wherein the first radial opening and the second radial opening are created simultaneously.

13. The method of claim 1, wherein injecting the barrier fluid comprises injecting the barrier fluid into the second annular gap to a height of the barrier fluid, followed by injecting the barrier fluid into the first annular gap.

14. A method for sealing a well, comprising:

creating a first seal between an outer surface of a production tube and an inner surface of a first casing of the well, the production tube being nested inside the first casing and the first casing being nested inside a second casing;

creating a first radial opening in the production tube, the first radial opening having a greater downhole depth differential than the first seal;

creating a second radial opening in the first casing;

creating a second seal between a barrier fluid injector and an inner surface of the production tube; and injecting a barrier fluid into an internal cavity of the production tube, wherein injecting the barrier fluid causes the barrier fluid to flow through the first radial opening into a first annular gap between the production tube and the first casing, the first seal prevents the barrier fluid from flowing in an upward direction within the first annular gap, and injecting the barrier fluid causes the barrier fluid to flow through the second radial opening into a second annular gap between the first casing and the second casing;

wherein creating the first seal comprises:

initiating a firing sequence of a perforating gun to create a third radial opening in the production tube; and injecting a material through the third radial opening to solidify inside the first annular gap.

15. The method of claim 14, wherein the material comprises cement.

16. The method of claim 14, comprising repeating the method at a plurality of depths in the well.

17. A method for sealing a well, comprising:

creating a first seal between an outer surface of a production tube and an inner surface of a first casing of the well, the production tube being nested inside the first casing and the first casing being nested inside a second casing;

creating a first radial opening in the production tube, the first radial opening having a greater downhole depth differential than the first seal;

creating a second radial opening in the first casing, wherein the first radial opening and the second radial opening are created simultaneously;

creating a second seal between a barrier fluid injector and an inner surface of the production tube; and injecting a barrier fluid into an internal cavity of the production tube, wherein injecting the barrier fluid causes the barrier fluid to flow through the first radial opening into a first annular gap between the production tube and the first casing, the first seal prevents the barrier fluid from flowing in an upward direction within the first annular gap, and injecting the barrier fluid causes the barrier fluid to flow through the second radial opening into a second annular gap between the first casing and the second casing.

18. The method of claim 17, wherein creating the first radial opening in the production tube and creating the second radial opening in the first casing are performed with a perforating gun.

19. The method of claim 17, wherein creating the first seal comprises at least one of:

radially forcing the production tube and the first casing toward one another;

radially forcing contact between the outer surface of the production tube and the inner surface of the first casing; or solidifying a material in the first annular gap above the first radial opening and the second radial opening.

20. The method of claim 17, comprising repeating the method at a plurality of depths in the well.

* * * * *